US005547017A

United States Patent [19]

Rudd

[11] Patent Number: 5,547,017

[45] Date of Patent: Aug. 20, 1996

[54] AIR DISTRIBUTION FAN RECYCLING CONTROL

[75] Inventor: Armin Rudd, Cocoa, Fla.

[73] Assignee: University of Central Florida, Orlando, Fla.

[21] Appl. No.: 369,180

[22] Filed: Jan. 5, 1995

[51] Int. Cl.[6] ..... F24F 7/00; F24F 1/00

[52] U.S. Cl. ..... 165/244; 62/231; 236/49.3; 454/233; 165/270

[58] Field of Search ..... 236/49.3, 46 R; 454/256, 258, 229, 233; 165/16, 12; 62/231

[56] References Cited

U.S. PATENT DOCUMENTS

| | | | |
|---|---|---|---|
| 2,882,383 | 4/1959 | Boyd Jr. et al. | 236/49.3 X |
| 3,454,078 | 3/1968 | Elwart | 236/9 X |
| 4,167,966 | 9/1979 | Freeman | 165/2 |
| 4,267,967 | 5/1981 | Beck et al. | 236/49.3 |
| 4,452,391 | 6/1984 | Chow | 236/49 |
| 4,718,021 | 1/1988 | Timblin | 364/505 |
| 4,773,587 | 9/1988 | Lipman | 236/11 |
| 5,131,236 | 7/1992 | Wruck et al. | 62/173 |
| 5,179,524 | 1/1993 | Parker et al. | 364/505 |
| 5,325,286 | 6/1994 | Weng et al. | 364/141 |

FOREIGN PATENT DOCUMENTS

| | | | |
|---|---|---|---|
| 0095538 | 6/1982 | Japan | 62/231 |
| 0008544 | 1/1986 | Japan | 62/231 |

*Primary Examiner*—William E. Wayner
*Attorney, Agent, or Firm*—Brian S. Steinberger

[57] ABSTRACT

An system for controlling the operation of the circulating fan of a closed central air conditioning(CAC) system is disclosed. The system periodically activates and deactivates only the circulating fan after a preselected delay time from the normal running of the cooling and heating modes of the CAC system. The preselected delay time is adjustable based on non thermostat parameters and include parameters such as room volume size to be ventilated and the number of occupants in the room. The control can periodically distribute and mix ventilation air or spot-conditioned (humidified, de-humidified, or cleaned) air while the CAC system is not running in the heating, cooling or constant fan modes. The cooling and heating modes of the CAC system operate independently of the fan recycling control.

18 Claims, 5 Drawing Sheets

AIR DISTRIBUTION FAN RECYCLING CONTROL

This invention relates to distributing air and in particular to a control for periodically energizing the air-distribution fan in a central air-conditioning system(CAC) having heating and/or cooling modes, in order to operate the fan for a selectable time period when the CAC system is not operating in the heating, cooling or constant fan modes. Wherein the recycling control operates the fan at periodic selected times that are dependent on the when the last cooling, heating, or constant fan mode had occurred.

BACKGROUND AND PRIOR ART

Current fans in Central Air Conditioning(CAC) systems for residential homes normally operate only when the CAC system is operating in a heating mode or a cooling mode. Alternatively, the fans in the CAC systems can be left in the on mode all the time. However, such a constant running of a fan system would constitute a waste of energy and power.

In CAC systems, a central heating or air cooling unit produces heated or cooled air. Normally, the heated or cooled air is directed from the heating or cooling unit through various ducts located throughout a building in order to place the heated or cooled air at desirable locations. Blowers, fans or air-type handlers generally are used to move the heated or cooled air through the ducts. Generally, thermostats are used to actuate the heating and cooling units. For example, when the air-temperature within a structure drips below a selected level, a thermostat can be adjusted to activate a heating mode when heating is desired. Likewise, when the air-temperature within a structure rises above a selected level, the thermostat can be adjusted to activate a cooling mode when cooling is desired. The CAC system is switched off when the interior air-temperature within the structure again reaches the desired selected temperature level.

Many CAC systems for heating and cooling structures use the thermostat to simultaneously activate both the fan along with the heating or cooling unit. In these systems the thermostat is usually used to simultaneously switch off both the fan and heating/cooling unit. In some heating CAC systems, the fan may continue to run after the heating unit has been shut off usually until residual heat in the heating unit has been removed. Alternatively, in some cooling CAC systems. the fan may continue to run after the cooling unit has been shut off to remove residual cool air from the cooling unit. However, no known systems exist that control the fan itself to turn on or off based on the last time the heating or cooling or constant fan modes have been activated.

Standards enacted in 1989 by the American Society of Heating, Refrigeration and Air-conditioning Engineers(ASHRAE) such as the 62 fresh air standard now require 15 cubic feet of outside air per person which translates to approximately 0.35 air changes per hour for residential buildings. The ASHRAE further includes an air quality standard which recommends a maximum concentration of $CO_2$ of 1000 ppm(parts per million).

The Manufactured Home Construction and Safety Standards set forth by the U.S. Department of Housing and Urban Development(HUD) has enacted new standards for manufactured homes that take effect in October of 1994. The HUD standards require fresh air ventilation systems for all manufactured housing in the United States. These ventilation systems must distribute outdoor air throughout the conditioned living space. Some ventilation systems require the installation of supply ducts separate from those of the CAC system, to distribute ventilation air. The separate ventilation supply ducts are potentially an unnecessary additional expense.

SUMMARY OF THE INVENTION

The first objective of the present invention is to provide a control system for using the existing circulating fan and supply ducts of a normal central air conditioning system-(CAC) for the periodic distributing and mixing of ventilation air throughout the air space served by the CAC system while the CAC system is not running in the heating, cooling or constant fan modes, where the periodic ON/OFF control of the fan is dependent on the time since the last fan operation, and where ventilation air is usually outdoor fresh air having a better air quality than indoor air, and provided that ventilation air is not otherwise distributed throughout the conditioned space by separate supply ducts and the fan.

The second object of this invention is to provide a control system for using the existing circulating fan and supply ducts of a normal central air conditioning system for the periodic distributing and mixing of spot-conditioned air throughout the air space served by the CAC system while the CAC system is not running in the heating, cooling or constant fan modes, where the periodic ON/OFF control of the fan is dependent on the time since the last fan operation, where spot-conditioned air can be humidified air or dehumidified air or cleaned air, and provided that the spot-conditioned air is not otherwise distributed throughout the conditioned space by separate supply ducts and the fan.

The third object of this invention is to provide a control system for using the existing circulating fan supply ducts of a normal central air conditioning system for the periodic averaging of the temperature of air throughout the air space served by the CAC system while the CAC system is not running in the heating, cooling or constant fan modes, and where the periodic ON/OFF control of the fan is dependent on the time since the last fan operation.

The fourth object of this invention is to provide a control system for using the existing circulating fan and supply ducts of a normal central air conditioning system for the periodic averaging of the humidity of air throughout the air space served by the CAC system while the CAC system is not running in the heating, cooling or constant fan modes, and where the periodic ON/OFF control of the fan is dependent on the time since the last fan operation.

The fifth object of this invention is to provide a control system for using the existing circulating fan and supply ducts of a normal central air conditioning system for the periodic remixing of existing air throughout the air space served by the CAC system while the CAC system is not running in the heating, cooling or constant fan modes, and where the periodic ON/OFF control of the fan is dependent on the time since the last fan operation.

The sixth object of this invention is to provide a system for periodically averaging the $CO_2$ air quality in a residential home that has a CAC system depending on a selectable time since the CAC system fan last operated, in order to keep the concentration of $CO_2$ to be less than 1000 ppm.

A fan recycling control for a CAC system is disclosed. The recycling control is energized when the Central Air Conditioning(CAC) system thermostat switch is open. The recycling control is used when there is no call by the CAC system for heating, cooling or a constant fan mode condition which would energize the CAC system fan.

In a preferred embodiment, a Central Air Conditioning system stays in an on mode status by sending out heated or cooled air with the circulating fan operating until a desired temperature is reached. At this selected thermostat temperature, the CAC system and circulating fan shuts off. The subject invention starts only the circulating fan after a preselected delay (an OFF delay) has occurred. Only the fan then operates to circulate air for a preselected time period(ON time). The preselected OFF delay is adjustable based on either or both the volume size of the air spaces served by the CAC system and/or by the number of people in the space served by the CAC system. The preselected ON time is adjustable based on the flow rate of the fan and the volume of the air spaces served by the CAC system. Thus, the fan recycling control will periodically turn the CAC system fan ON and OFF until the thermostat switch on the CAC system reactivates either the cooling or heating modes, or the constant fan mode is selected, at which time the fan recycling control is de-energized.

Installation of the invention would generally require removal of the front cover of the CAC system cabinet to expose the CAC system control terminal block. The terminal block is the general location where all external CAC system control wiring terminals are inside the CAC system cabinet.

The recycling control system invention can be effective on many different types of Central Air Conditioning(CAC) systems. For example, the invention can be equally applied to a cooling only CAC system, a cooling CAC system with electric heat, a heat pump CAC system, a closed gas or off furnace system, and any combination of these systems.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
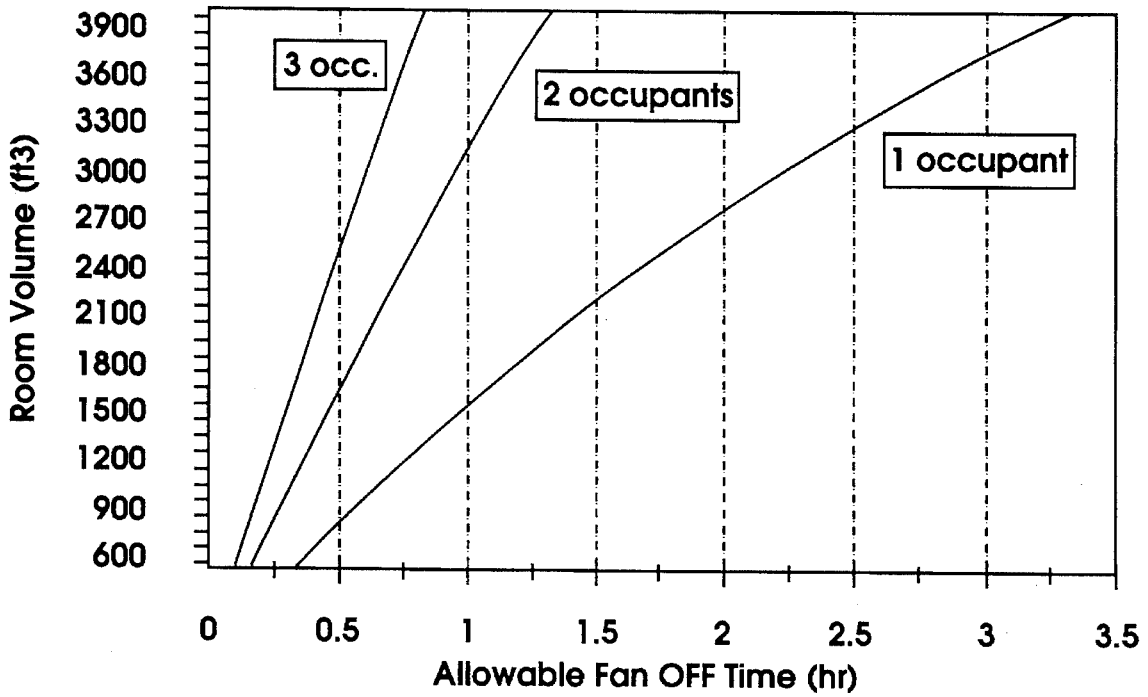
FIG. 1 shows a graph representing the adequate delay time a fan system could stay off based on the number of sedentary occupants and the volume of a room to be ventilated that will most generally experience the fastest increase in $CO_2$ concentration.

FIG. 1 shows a graph representing the adequate delay time a fan system could stay off based on the number of sedentary occupants and the volume of a room to be ventilated that will most generally experience the fastest increase in $CO_2$ concentration.

Using FIG. 1, the recycle control delay time for the fan system of an entire residence would be set based on the room that is expected to have the smallest ratio of air volume to the number of occupants in the room. For example, if a masterbedroom has a volume of 1,600 cubic feet(ft.$^3$) and two occupants, the volume to occupancy ratio would be 1,600/2=800. Using FIG. 1, a 1,600 ft.$^3$ volume room holding two occupants would have a delay time of 0.5 hours or half an hour. Therefore, the selectable time delay on the fan recycle control should activate the fan only ½ hour after the last fan operation. If one person was in the room, the delay time would be approximately 1 hour. Consequently, if a maximum of three people were in the room, the delay time would be approximately ¼ of an hour.

In residential homes where more than one CAC system exists to serve separate zones, each CAC system can have its own fan recycling control. And each control can be set accordingly to this same above described standard for one fan system that is used for an entire home.

First Embodiment.

Figure 2:
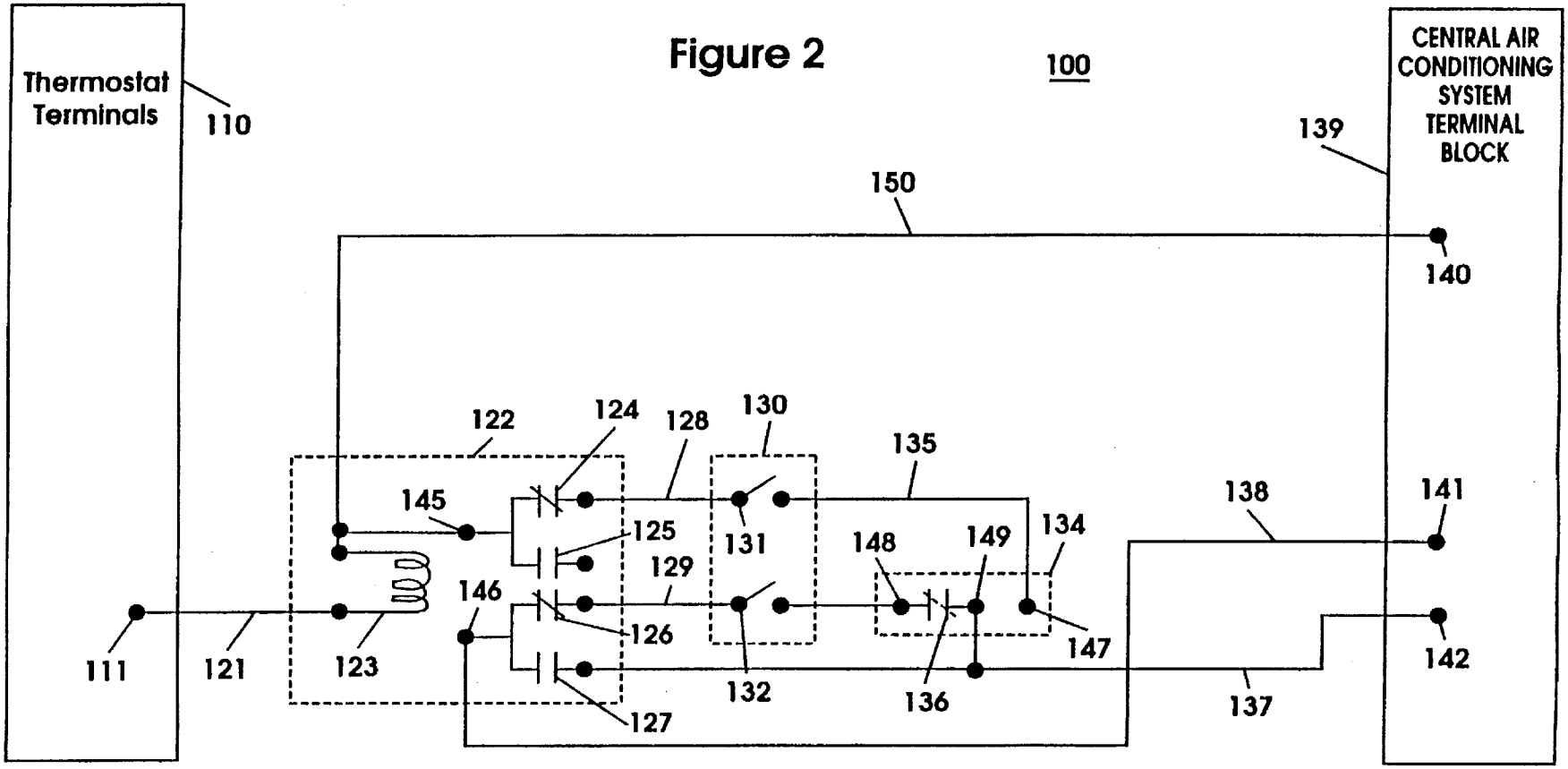
FIG. 2 shows a first preferred embodiment of the air distribution recycling control system for a CAC system that will always energize the CAC system fan through the fan relay terminal when there is a call for heating, cooling or constant fan mode operation.

FIG. 2 shows a first preferred embodiment of the air distribution recycling control system 100 for a CAC system that will always energize the CAC system fan through the fan relay terminal when there is a call for heating, cooling or constant fan mode operation. The components of FIG. 2 will now be described.

Referring to FIG. 2, component 110 refers to the thermostat enclosure for housing terminal connection contacts, which include fan contact 111, often marked as G on a thermostat. 121 is wire connecting contact, 111, G, to the power input side of the 24 Vac relay coil, 123 Element 122 is a double-pole double-throw relay with 24 Vac coil, 123. Component 124 is a normally closed (NC) contact. 125 is a normally open (NO) contact. 126 is a normally closed (NC) contact. 127 is a normally open (NO) contact. 128 refers to the wire connecting contact 124 to switch 131 described below. 129 connects 126 to 132. 130 is a double-pole single-throw switch. 131 refers to pole 1 of switch, 130. Component 132 refers to pole 2 of switch, 130. 134 is a solid-state recycling timer. 135 refers to the wire connecting pole, 131 to common side of timer, 134. 136 is a solid-state switch. 137 is a wire connecting power terminal, 149(described below) and contact, 127 to fan control terminal, 142. 138 refers to the wire connecting pole, 146(described below) to power terminal, 41 (described below. 139 is the CAC system terminal block enclosure. Component 140 refers to the 24 Vac common terminal of the CAC system terminal block. 141 is the 24 Vac power terminal of CAC system terminal block. Component 142 refers to the fan control terminal of the CAC system terminal block. 143 is pole 1 of element 115. Element 144 is pole 2 of element 115. 145 is pole 1 of box, 122. Component 146 is pole 2 of box, 122. Component 147 is the common terminal of 134. Component 148 is the power terminal of 134. Component 149 is the switched power terminal of 134. Element 150 refers to the wire connecting the common side of Vac coil., 123 to common terminal, 140.

The operation of the components in FIG. 2 will now be described for CAC systems which always energize the system fan through the fan control terminal 142. Referring to FIG. 2, the air distribution system fan recycling control is electrically wired between the thermostat and the central air conditioning (CAC) system terminal block. Specifically, that is between the fan control line of the thermostat and the fan control line and the 24 Vac power supply(line 1 and common) of the CAC system terminal block. When the thermostat fan control line 121 is energized, the 24 Vac coil 123 closes contact 127 which allows current to flow to the fan terminal 142 on the CAC system terminal block. At the same time, contacts 124 and 126 are opened which de-energizes and resets the solid-state recycling timer 134. When the thermostat fan control line 121 is de-energized, the 24 Vac coil 123 is de-energized and the contact 127 opens, cutting off current flow to the fan control terminal 142. At the same time, contacts 124 and 126 close, which energizes the solid-state recycling timer, 134. While the recycling timer 134 is energized the timer will continuously cycle through a pre-selected OFF delay, during which time the fan control terminal 142 is de-energized, and a pre-selected ON delay, during which time the fan control terminal 142 is energized.

Figure 3:
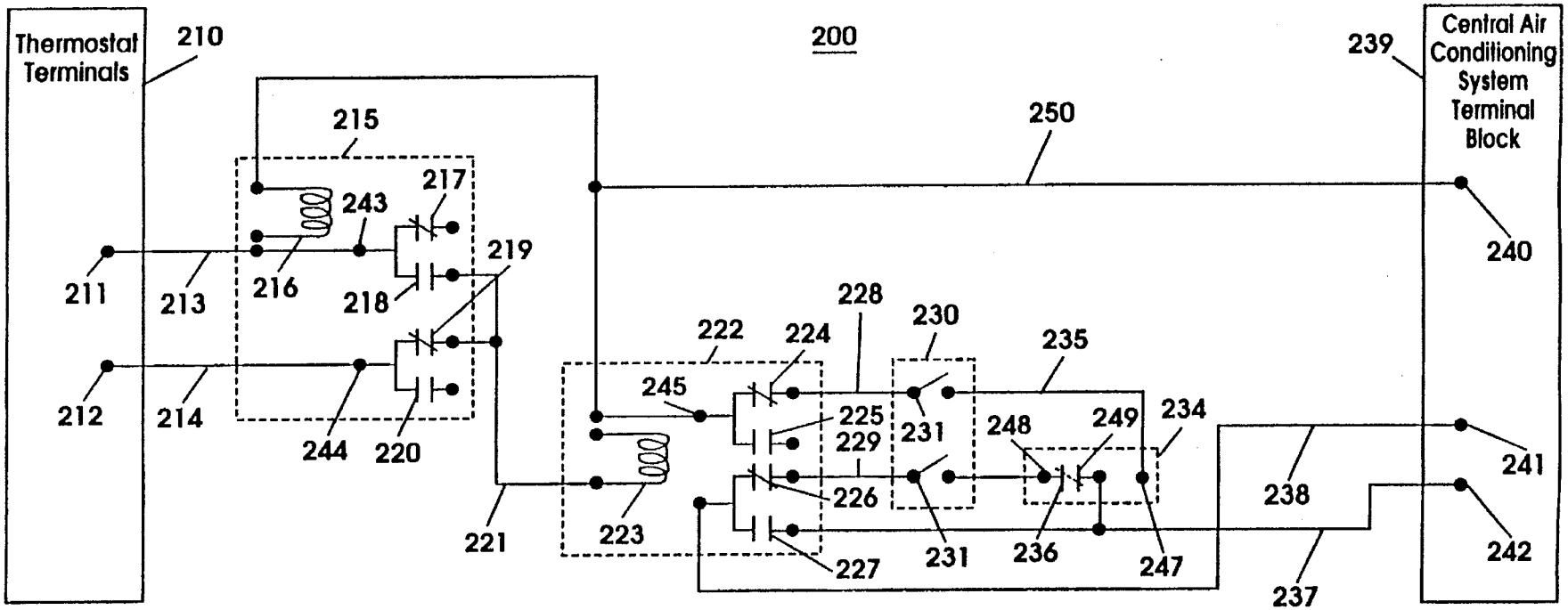
FIG. 3 shows a second preferred embodiment of the air distribution recycling control system for a CAC system that does not always energize the CAC system fan through the fan relay terminal on the CAC system terminal block when there is a call for heating or cooling modes.

FIG. 3 shows a second preferred embodiment of the air distribution recycling control system for a CAC system that does not always energize the CAC system fan through the fan relay terminal on the CAC system terminal block when there is a call for heating or cooling modes. The components of FIG. 3 will now be described.

Component 210 is the thermostat enclosure. 211 is the fan control terminal, G, of the thermostat. 212 the heat control terminal, W, of the thermostat. Component 213 is the wire connecting terminal 211, to the power input side of the 24 Vac relay coil, 216 and pole 1,243 of the double-pole double-throw relay (DPDT), 215. Element 214, is the wire connecting terminal 212 to pole 2, 244 of the DPDT relay, 215. Component 216 is the 24 Vac coil. 217 is the normally closed (NC) contact. 218 is the normally open (NO) contact. 219 is normally closed (NC) contact. 220 is the normally open (NO) contact. 221 is the wire connecting contact 218, and contact 219 to the power input side of the 24 Vac relay coil, 223. Component 222 is the double-pole double-throw relay with 24 Vac coil, 223. Component 224 is a normally closed (NC) contact. 225 is a normally open (NO) contact. 226 is a normally closed (NC) contact. 227 is a normally open (NO) contact. 228 refers to a wire connecting contact 224, to switch 231. 229 is the wire connecting contact 226, to switch 232. Component 230 is a double-pole single-throw switch that includes pole 1 and pole 2. Component 233 is the wire connecting pole 2, 232 to power input side of solid state recycling timer, 234. Component 237 refers to a wire connecting terminal 249 and contact 227 to fan control terminal 242. Component 238 is a wire connecting pole 2, 246 to terminal 241. Component 239 signifies the CAC system terminal block enclosure. 240 is the 24 Vac common terminal of CAC system terminal block. 241 is the 24 Vac power terminal of CAC system terminal block. 243 refers to pole 1 of relay 215. 244 refers to pole 2 of relay, 215. 245 is pole 1 of relay, 222. 246 is pole 2 of relay, 222. Component 247 is the common terminal and 248 is to power terminal of timer 234. 249 is the switched power terminal of timer 234. Wire 250 connects the common side of coil 216 and coil 223 to common terminal 240.

The operation of the components in FIG. 3 will now be described for CAC systems which do not always energize the system fan through the fan control terminal 142. Referring to FIG. 3, the air distribution system fan recycling control is electrically wired between the thermostat 210 and the central air conditioning (CAC) system terminal block 239. Specifically, that is between the fan control line 211 and the heat control line 212 of the thermostat and the fan control line 211 and the 24 Vac power supply 216 (line 1 and common) of the CAC system terminal block 239. When the thermostat fan control line 213 is energized, the 24 Vac coil 216 closes contact 218 and opens contact 219, which energizes the 24 Vac coil 223 and blocks current flow back through the thermostat heat control line 214. When the thermostat heat control line 214 is energized, the 24 Vac coil 216 remains de-energized and the 24 Vac coil 223 is energized through normally closed contact 219, while normally open contact 218 blocks current flow back through the thermostat fan control line 213. When the line 221 is energized, the 24 Vac coil 223 closes contact 227 which allows current to flow to the fan terminal 242 on the CAC system terminal block 239. At the same time contacts 224 and 226 are opened which de-energizes and resets the solid-state recycling timer 234. When the line 221 is de-energized, the 24 Vac coil 223 is de-energized and the contact 227 opens, cutting off current flow to the fan control terminal 242. At the same time, contacts 224 and 226 close, which energizes the solid-state recycling timer, 234. While the recycling timer 234 is energized, the timer will continuously cycle through a pre-selected OFF delay, during which time the fan control terminal 242 is de-energized, and a pre-selected ON delay, during which time the fan control terminal 242 is energized.

Figure 4:
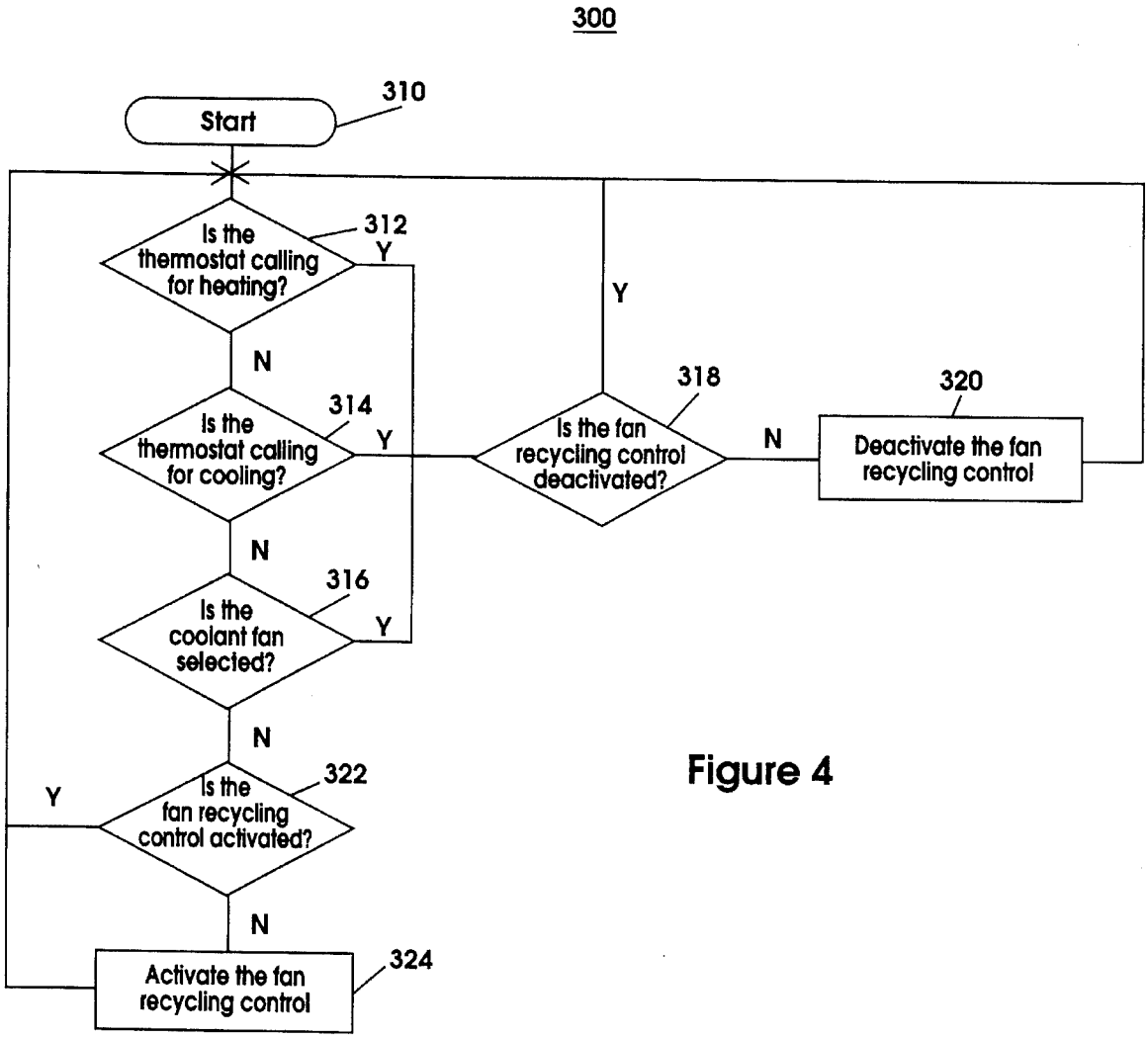
FIG. 4 illustrates an algorithm for activating and deactivating the air distribution system fan recycling control by a microprocessor.

The subject invention of FIGS. 1–3 can be applied to a microprocessor based control. FIG. 4 illustrates an algorithm for activating and deactivating the air distribution system fan recycling control by a microprocessor. The algorithm of FIG. 5 can be programmed in a microprocessor based thermostat and the like to effect the same control function as the air distribution system fan recycling control of FIG. 2 and FIG. 3.

The algorithm of FIG. 4 will now be described. The algorithm to activate the air distribution system fan recycling control using a microprocessor based thermostat or other microprocessor control starts at 310. At 312, 314, and 316 the program checks if the thermostat is calling for heating, cooling or constant fan, respectively. If any of those modes are active, the program goes to 318 where it checks if the fan recycling control has already been deactivated. If it has, the program loops back to 312, if it hasn't the program deactivates the fan recycling control and loops back to 312. If neither heating or cooling or constant fan mode is active the program loops back to 312, if it hasn't, the fan recycling control is activated at 324 and the program loops back to 312.

Figure 5:
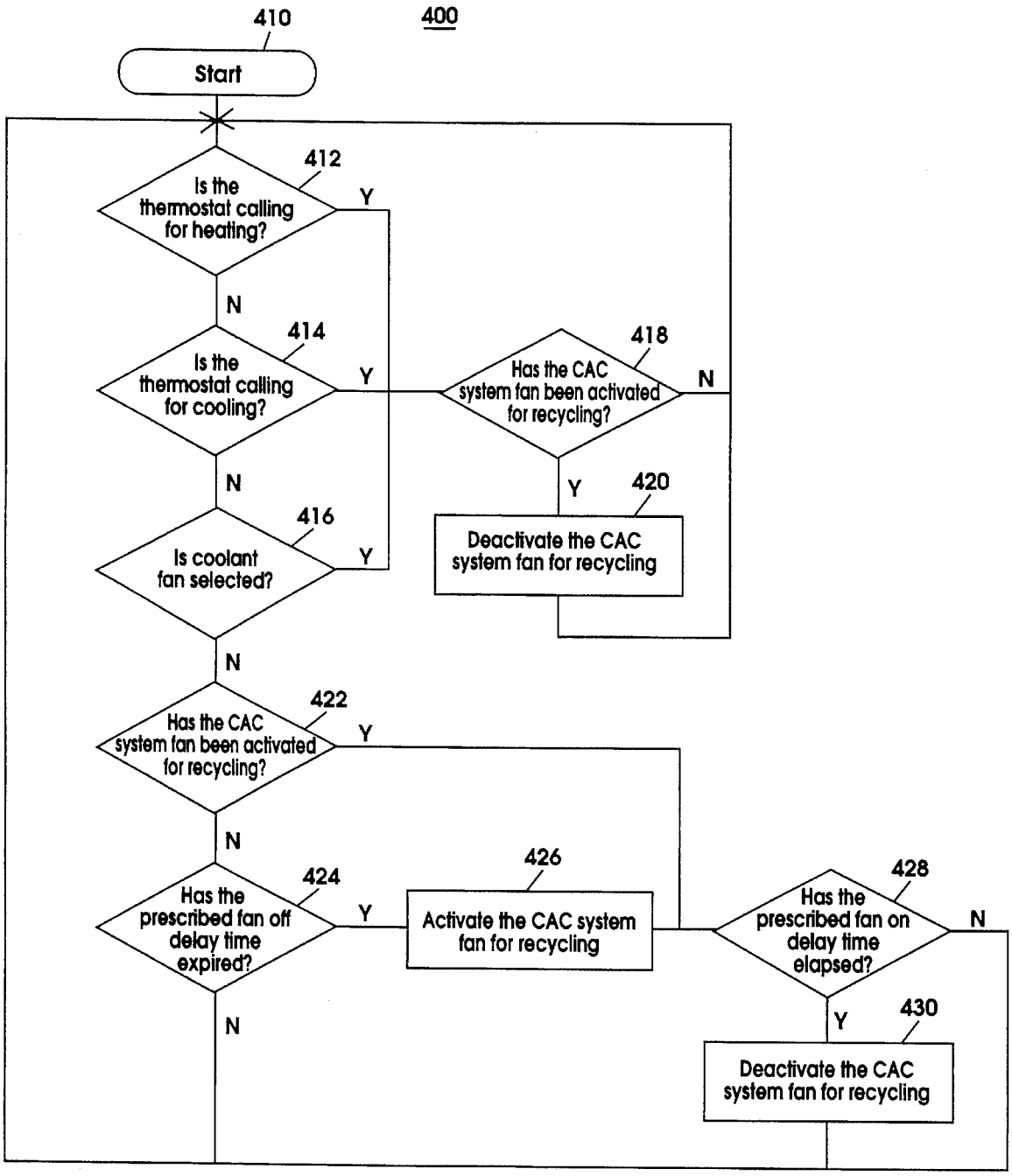
FIG. 5 illustrates an algorithm for providing the same function as the fan recycling control by a microprocessor control.

The algorithm of FIG. 5 will now be described. The algorithm to replace the air distribution system fan recycling control of FIG. 2 and FIG. 3 with a microprocessor based control starts at 410. At 412, 414, and 416 the program checks if the thermostat is calling for heating, cooling or constant fan, respectively. If any of those modes are active, the program goes to 418 where it checks if the CAC system has been activated for recycling. If it has not, the program loops back to 412, if it has, the program deactivates the CAC system fan for recycling and loops back to 412. If neither heating or cooling or constant fan mode is active, the program goes to 422 to check if the CAC system fan has been activated for recycling. If it has, the program goes to 428 to check if the prescribed FAN ON time delay has elapsed. If it has not elapsed, the program loops back to 412, if it has elapsed, the program deactivates the CAC system fan for recycling and loops back to 412. If the CAC system fan has not been activated at 422, the program goes to 424 to check if the prescribed FAN OFF delay time has expired. If it has not expired, the program loops back to 412. If the FAN OFF time has expired, the program goes to 426 to activate the CAC system fan for recycling, then to 428 as described above.

Although FIG. 2 and FIG. 3 show both electromechanical and solid-state components, the subject invention could be made with all solid-state components.

Although the graph of FIG. 1 shows room volumes from 600 up to 4,000 ft.$^3$ and occupants of one to three, the graph can be increased and decreased for other values.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A fan recycling control apparatus for a central air conditioning(CAC) system comprising:

a circulating fan;

a central air conditioning system with ducts to distribute cooled and heated conditioned air throughout a building;

a thermostat for activating and deactivating both the central air conditioning system and the circulating fan; and a recycle control for periodically activating and deactivating only the circulating fan after a preselected time period, since the central air conditioning system or the circulating fan have been deactivated.

2. The recycling control apparatus of claim 1, where the air conditioning system includes:

a cooling only mode.

3. The recycling control apparatus of claim 1, where the air conditioning system includes:

a cooling mode and a electric heat mode.

4. The recycling control apparatus of claim 1, where the air conditioning system includes:

a heat pump.

5. The recycling control apparatus of claim 1, where the air conditioning system includes:

a gas heat source.

6. The recycling control apparatus of claim 1, where the air conditioning system includes:

an oil heat source.

7. The recycling control apparatus of claim 1, where the preselected time period includes:

a time delay based on number of occupants within the building to be ventilated.

8. The recycling control apparatus of claim 1, where the preselected time period includes:

a time delay based on volume dimensions of the building to be ventilated.

9. The recycling control apparatus of claim 1, where the preselected time period includes:

a time delay based on both number of occupants and volume dimensions of an air-space to be ventilated.

10. A method of mixing air throughout a building when not running a heating and cooling air conditioning system comprising the steps of:

shutting off both cooling and heating modes on an air-conditioning system;

activating a circulating fan only after preselected delay time periods, wherein each the delay time periods is adjusted based on nontemperature conditions, wherein the nontemperature conditions are chosen from at least one of:

volume dimensions of an air-space to be ventilated and number of occupants of the air-space to be ventilated.

11. The method of claim 10, wherein each of the delay time period is selected from:

a range of approximately 20 minutes to approximately 3 hours for a room having volume dimensions between 600 to 3800 cubic feet, when 1 occupant is within the room.

12. The method of claim 10, wherein each of the delay time period is selected from:

a range of approximately 12 minutes to approximately 1 and ¼ hours for a room having volume dimensions between 600 to 3800 cubic feet, when 2 occupants are within the room.

13. The method of claim 10, wherein each of the delay time period is selected from:

a range of approximately 10 minutes to approximately ¾ of an hour for a room having volume dimensions between 600 to 3800 cubic feet, when 3 occupants are within the room.

14. The method of claim 10, further including the step of:

turning on the heating and the cooling modes of the air-conditioning system when a temperature threshold has been reached.

15. An automated fan recycling control apparatus for a central air conditioning(CAC) system comprising:

a circulating fan;

a central air conditioning system with ducts to distribute cooled and heated conditioned air throughout a building;

a thermostat for activating and deactivating both the central air conditioning system and the circulating fan; and a recycle control for periodically activating and deactivating only the circulating fan after a preselected time period based on selected nontemperature conditions, since the central air conditioning system or the circulating fan have been deactivated, and wherein the nontemperature conditions are chosen from at least one of:

volume dimensions of an air-space to be ventilated and number of occupants of the air-space to be ventilated.

16. The automated fan recycling control apparatus of claim 15, wherein the preselected time period is selected from:

a range of approximately 20 minutes to approximately 3 hours for a room having volume dimensions between 600 to 3800 cubic feet, when 1 occupant is within the room.

17. The automated fan recycling control apparatus of claim 15 wherein the preselected time period is selected from:

a range of approximately 12 minutes to approximately 1 and ¼ hours for a room having volume dimensions between 600 to 3800 cubic feet, when 2 occupants are within the room.

18. The automated fan recycling control apparatus of claim 15, wherein the preselected time period is selected from:

a range of approximately 10 minutes to approximately ¾ of an hour for a room having volume dimensions between 600 to 3800 cubic feet, when 3 occupants are within the room.

* * * * *

US005547017B1

REEXAMINATION CERTIFICATE (4219th)

United States Patent [19]

Rudd

[11] B1 5,547,017

[45] Certificate Issued Nov. 28, 2000

[54] AIR DISTRIBUTION FAN RECYCLING CONTROL

[75] Inventor: Armin Rudd, Cocoa, Fla.

[73] Assignee: University of Central Florida, Orlando, Fla.

Reexamination Request:
No. 90/005,044, Jul. 21, 1998

Reexamination Certificate for:

| | |
|---|---|
| Patent No.: | **5,547,017** |
| Issued: | **Aug. 20, 1996** |
| Appl. No.: | **08/369,180** |
| Filed: | **Jan. 5, 1995** |

[51] Int. Cl.[7] ..... F24F 7/00; F24F 1/00

[52] U.S. Cl. ..... 165/244; 62/231; 165/270; 236/49.3; 454/233

[58] Field of Search ..... 236/11, 49.3; 62/180; 165/267, 214

[56] References Cited

U.S. PATENT DOCUMENTS

| | | | |
|---|---|---|---|
| 2,495,861 | 1/1950 | Newton | 236/11 X |
| 2,882,383 | 4/1959 | Boyd, Jr. et al. | 219/39 |
| 3,454,078 | 7/1969 | Elwart | 236/9 X |
| 3,635,044 | 1/1972 | Heth | 62/157 |
| 3,948,438 | 4/1976 | Vlasak | 62/202 X |
| 4,011,735 | 3/1977 | Martz et al. | 62/186 |
| 4,075,864 | 2/1978 | Schrader | 62/180 |
| 4,136,822 | 1/1979 | Felter | 236/49.3 |
| 4,167,966 | 9/1979 | Freeman | 62/180 X |
| 4,267,967 | 5/1981 | Beck et al. | 236/49.3 |
| 4,356,962 | 11/1982 | Levine | 236/11 |
| 4,369,916 | 1/1983 | Abbey | 236/11 |
| 4,408,711 | 10/1983 | Levine | 236/11 |
| 4,449,375 | 5/1984 | Briccetti | 62/89 |
| 4,452,391 | 6/1984 | Chow | 236/49.3 |
| 4,467,617 | 8/1984 | Morgan, Jr. et al. | 62/180 |
| 4,502,625 | 3/1985 | Mueller | 236/11 |
| 4,595,139 | 6/1986 | Levine | 236/44 R |
| 4,684,060 | 8/1987 | Adams et al. | 236/11 |
| 4,718,021 | 1/1988 | Timblin | 236/46 R |
| 4,773,587 | 9/1988 | Lipman | 236/11 |
| 4,838,482 | 6/1989 | Vogelzang | 236/11 |
| 4,930,460 | 6/1990 | Aihara et al. | 123/41.31 X |
| 4,941,325 | 7/1990 | Nuding | 62/158 |
| 4,951,473 | 8/1990 | Levine et al. | 62/82 |
| 5,020,332 | 6/1991 | Nakatsuno et al. | 62/157 |
| 5,131,236 | 7/1992 | Wruck et al. | 62/173 |
| 5,142,880 | 9/1992 | Bellis | 62/158 X |
| 5,179,524 | 1/1993 | Parker et al. | 236/49.3 |
| 5,239,834 | 8/1993 | Travers | 62/151 |
| 5,241,253 | 8/1993 | Schlangen | 318/779 |
| 5,325,286 | 6/1994 | Weng et al. | 236/1 B |

FOREIGN PATENT DOCUMENTS 61-8544 1/1986 Japan .

OTHER PUBLICATIONS

"Ventilation for Acceptable Indoor Air Quality," *ASHRAE™ STANDARD*, ASHRAE 62–1989 (28 pgs.).

*Primary Examiner*—William Wayner

[57] ABSTRACT

An system for controlling the operation of the circulating fan of a closed central air conditioning(CAC) system is disclosed. The system periodically activates and deactivates only the circulating fan after a preselected delay time from the normal running of the cooling and heating modes of the CAC system. The preselected delay time is adjustable based on non thermostat parameters and include parameters such as room volume size to be ventilated and the number of occupants in the room. The control can periodically distribute and mix ventilation air or spot-conditioned (humidified, de-humidified, or cleaned) air while the CAC system is not running in the heating, cooling or constant fan modes. The cooling and heating modes of the CAC system operate independently of the fan recycling control.

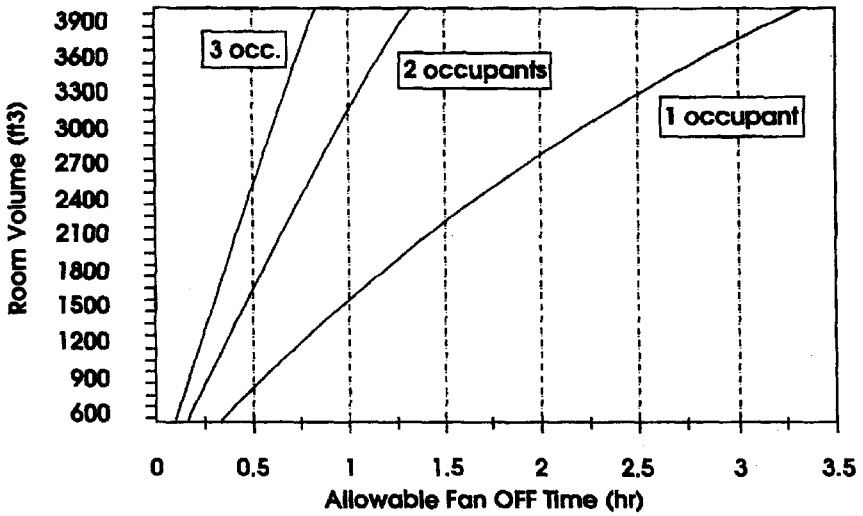

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 10–14 is confirmed.

Claims 1 and 15 are determined to be patentable as amended.

Claims 2–9 and 16–18, dependent on an amended claim, are determined to be patentable.

1. A fan recycling control apparatus for a central air conditioning (CAC) system comprising:

a circulating fan;

a central air conditioning system with ducts to distribute cooled and heated conditioned air throughout a building;

a thermostat for activating and deactivating both the central air conditioning system and the circulating fan;

*said activating causing a continuous fan operation, said deactivating causing no fan operation, said thermostat further having a selectable constant fan mode,* and a recycle control for periodically activating and deactivating only the circulating fan after a preselected time period, since the central air conditioning system *has been deactivated*, or the circulating fan [have] *has* been deactivated *from the selectable constant fan mode*.

15. An automated fan recycling control apparatus for a central air conditioning (CAC) system comprising:

a circulating fan;

a central air conditioning system with ducts to distribute cooled and heated conditioned air throughout a building;

a thermostat for activating and deactivating both the central air conditioning system and the circulating fan;

*said activating causing a continuous fan operation, said deactivating causing no fan operation, said thermostat further having a selectable constant fan mode*, and a recycle control for periodically activating and deactivating only the circulating fan after a preselected time period based on selected non-temperature conditions, since *either* the central air conditioning system *has been deactivated* or the circulating fan [have] *has* been deactivated[,] *from the selectable constant fan mode* and wherein the non-temperature conditions are chosen from at least one of:

volume dimensions of an air-space to be ventilated and number of occupants of the air-space to be ventilated.

* * * * *